US007524271B2

(12) United States Patent
Bendavid et al.

(10) Patent No.: US 7,524,271 B2
(45) Date of Patent: Apr. 28, 2009

(54) EXERCISE ASSEMBLY FOR A CHAIR AND A CHAIR HAVING SUCH AN EXERCISE ASSEMBLY

(76) Inventors: Joseph Bendavid, 9340 Monte Leon La., Beverly Hills, CA (US) 90210; Hongwei Jia, South sea rose garden Shekou, Nanshan District, ShenZhen, Guangdong (CN)

( * ) Notice: Subject to any disclaimer, the term of this patent is extended or adjusted under 35 U.S.C. 154(b) by 0 days.

(21) Appl. No.: 11/905,766

(22) Filed: Oct. 4, 2007

(65) Prior Publication Data

US 2008/0153680 A1 Jun. 26, 2008

(30) Foreign Application Priority Data

Dec. 21, 2006 (CN) ..... 2006 2 0016648

(51) Int. Cl.
*A63B 21/02* (2006.01)

(52) U.S. Cl. ..... 482/122; 482/142; 297/217.1; 297/344.12

(58) Field of Classification Search ..... 482/142, 482/148, 121–130; 297/217.1, 344.12
See application file for complete search history.

(56) References Cited

U.S. PATENT DOCUMENTS

| | | | | |
|---|---|---|---|---|
| 3,345,067 | A * | 10/1967 | Smith | 482/123 |
| 5,755,649 | A * | 5/1998 | Bimby | 482/126 |
| 7,125,365 | B2 * | 10/2006 | Krietzman | 482/112 |
| 2007/0037663 | A1 * | 2/2007 | Goel et al. | 482/1 |

* cited by examiner

*Primary Examiner*—Lori Amerson
(74) *Attorney, Agent, or Firm*—Rosenberg, Klein & Lee

(57) ABSTRACT

An exercise assembly for a chair includes a plurality of elastic members having a central portion extending between a joining member coupled to a bottom of the chair's seat and a fixing member coupled to a base of the chair. The tension force in each elastic member is adjusted by adjusting the height of the chair seat relative to the base to thereby change the distance between the fixing member and the joining member, and is substantially the same in each elastic member since they are generally uniformly stretched.

15 Claims, 3 Drawing Sheets

EXERCISE ASSEMBLY FOR A CHAIR AND A CHAIR HAVING SUCH AN EXERCISE ASSEMBLY

FIELD OF THE INVENTION

This invention relates to an attachment of a chair, in particular to an exercise assembly used for a chair.

This invention also relates to a chair, in particular to a chair used for exercise with the above-mentioned exercise assembly.

BACKGROUND OF THE INVENTION

Nowadays many office workers who usually sit on the chairs and face computers during their working-time have no time to take exercise for extended periods, so that their health is deteriorated.

Accordingly, a chair is developed in which an exercise assembly is attached to a conventional chair. Therefore, exercise may be taken in the office. However, the existing chairs have hulking structures such as metal chains, which are cumbersome to be conveyed. Elastic members are also used in some existing constructions in which, usually, only the elastic force of the elastic members themselves is used, but the elastic force is too small to be adjusted and is inconvenient to be used.

To sum up, the chairs are obviously inconvenient and flawed during use due to the disadvantages in their structures. There is therefore a need for improvement.

SUMMARY OF THE INVENTION

The object of this invention is to provide a kind of exercise assembly used in a chair to facilitate exercising.

The present invention also provides a chair having said exercise assembly to facilitate exercising:

In order to obtain the above object, in one aspect of the present invention, a chair used for exercise is provided, which comprises a backrest, a seat, a support provided under the seat, and an exercise assembly comprising:

a plurality of elastic members;

a fixing member fixed on the support, comprising: a base, and a first and second fixing part extending from two sides of the base, each fixing part having a plurality of mounting parts, the number of the mounting parts being corresponding to the number of the elastic members;

a joining member fixed under the seat and above the fixing member, and having a plurality of joining parts, the number of the joining parts being corresponding to the number of the elastic members;

wherein the elastic members sequentially pass through the corresponding mounting part of the first fixing member, the corresponding jointing part of the jointing member and the corresponding mounting part of the second fixing member, respectively.

In the chair of the present invention, the base of the fixing member may be a hollow column.

In the chair of the present invention, the mounting part may have an annular structure.

In the chair of the present invention, an air pump for adjusting a height of the seat may be provided on the support.

In the chair of the present invention, the number of the elastic members may be three.

Particularly, two ends of one of the three elastic members may be mounted on two sides of a top of the backrest, and the ends of the other two elastic members may be mounted under the seat.

In the chair of the present invention, the elastic member may be an elastic band.

In the chair of the present invention, a handle which is convenient to be grasped by a user may be provided at each end of the elastic member.

In the chair of the present invention, a receiving part for receiving the handle may be provided under the seat.

In another aspect of the present invention, an exercise assembly is provided, which comprises:

a plurality of elastic members;

a fixing member comprising: a base, a first and second fixing part extending from two sides of the base, each fixing part having a plurality of mounting parts, a number of the mounting parts be corresponding to a number of the elastic members; and a joining member having a plurality of joining parts, the number of the joining parts being corresponding to the number of the elastic members;

wherein the elastic members sequentially pass through the corresponding mounting part of the first fixing member, the corresponding jointing part of the jointing member and the corresponding mounting part of the second fixing member, respectively.

In the exercise assembly of the present invention, the number of the elastic members may be three.

In the exercise assembly of the present invention, the elastic member may be an elastic band.

In the exercise assembly of the present invention, the base of the fixing member may be a hollow column.

In the exercise assembly of the present invention, the mounting part may have an annular structure.

In the exercise assembly of the present invention, the joining part may have an annular structure.

This invention has two advantages:

1. The stretching equilibrium can be achieved. The tension force in each elastic member is substantially same, since all the elastic members are mounted through the fixing members and the joining members and thus are generally uniformly stretched when the distance between the fixing member and the joining member is adjusted.

2. An aesthetically advantageous appearance can be obtained. Tubular structures in which the elastic members can be hidden may be used in the chair. In particular, since the receiving part for receiving the handles is provided under the seat, a good appearance can be obtained.

| LIST OF PARTS | |
|---|---|
| 1 | exercise assembly |
| 11 | fixing member |
| 1121 | mounting part |
| 12 | elastic member |
| 131 | joining part |
| 2 | chair |
| 21 | backrest |
| 24 | sliding device |
| 27 | fixing block |
| 111 | base of fixing member |
| 113 | second fixing part |
| 13 | joining member |
| 14 | handle |
| 22 | seat |
| 25 | receiving part |
| 112 | first fixing part |
| 1131 | mounting part |
| 23 | support |
| 26 | air pump |

DESCRIPTION OF THE PREFERRED EMBODIMENT

Below is a further explanation of the present invention with reference to the attached drawing and embodiments:

The First Embodiment

Figure 1:
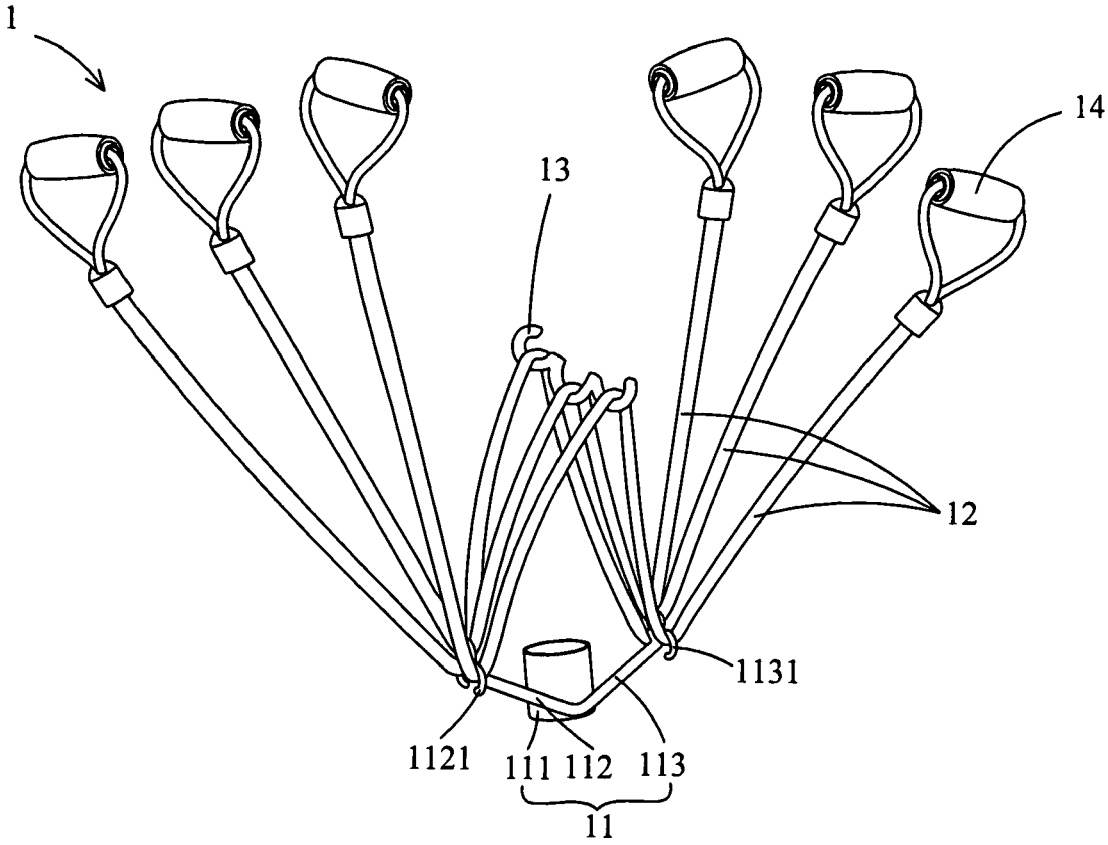
FIG. 1 is a perspective view of an exercise assembly according to the present invention.
Figure 2:
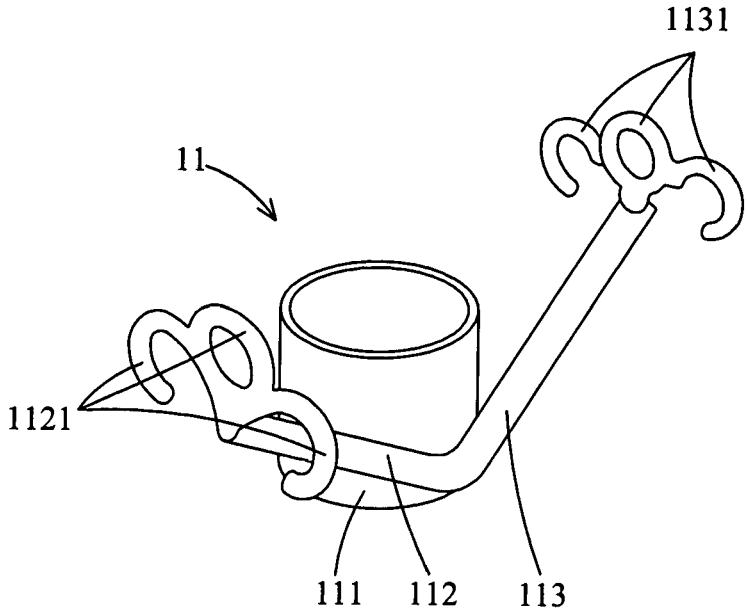
FIG. 2 is a perspective view of a fixing member in the exercise assembly according to the present invention.
Figure 3:
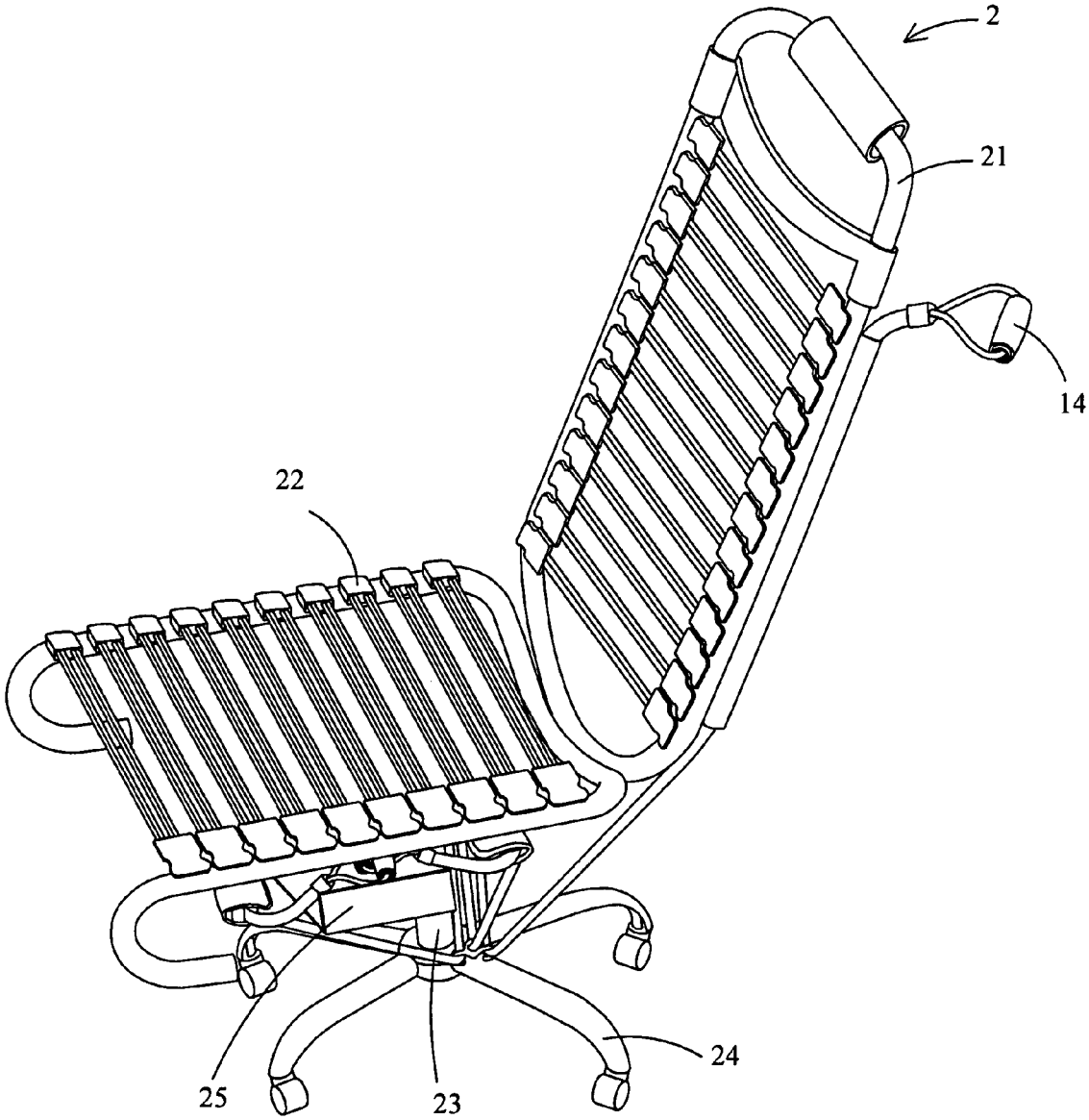
FIG. 3 is a perspective view of a chair used for exercise according to the present invention.
Figure 4:
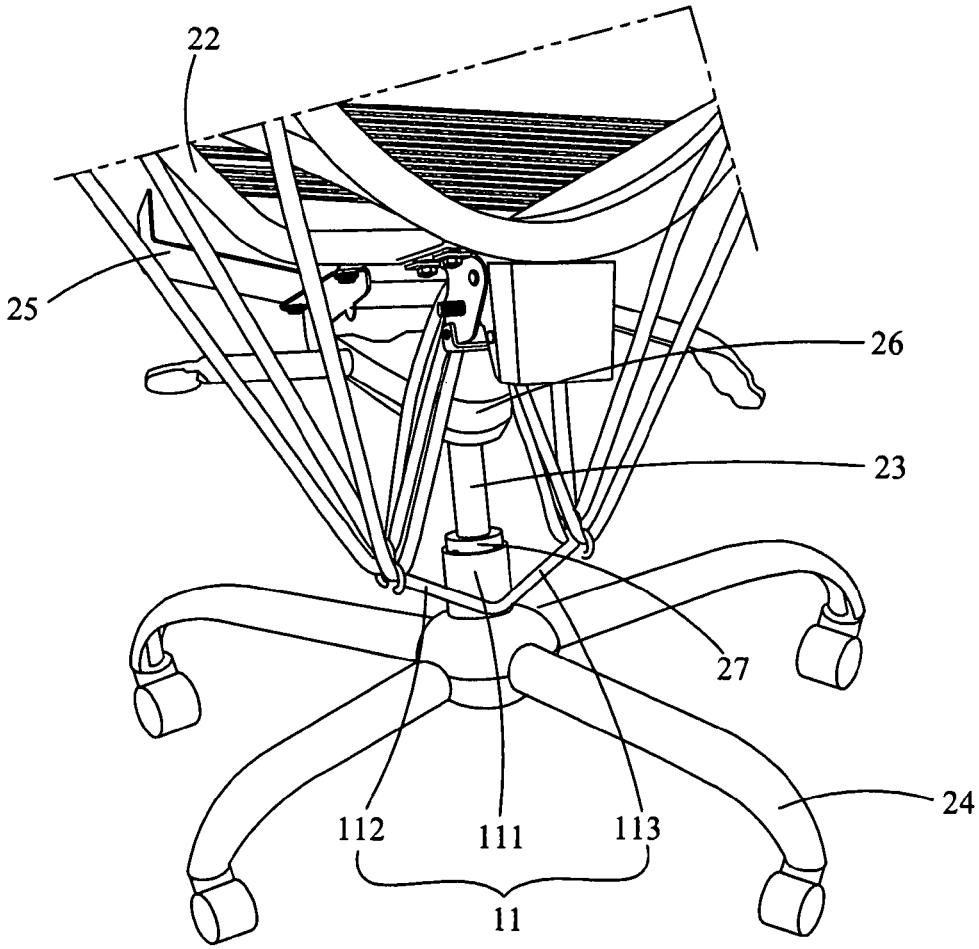
FIG. 4 is a partial view of a chair used for exercise according to the present invention showing a mounting state of the fixing member and elastic members of the exercise assembly.
Figure 5:
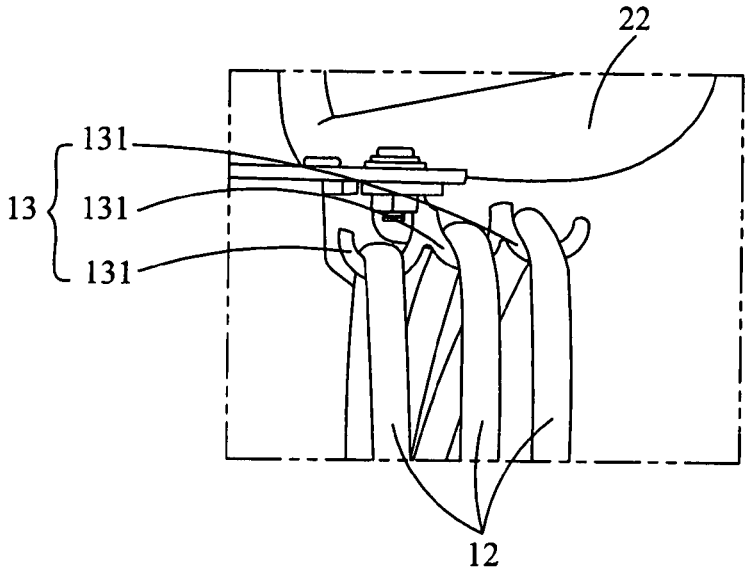
FIG. 5 is another partial view of a chair used for exercise according to the present invention showing a position of a joining member of the exercise assembly.

Referring to FIG. 1 and FIG. 2, an exercise assembly 1 for a chair comprises a fixing member 11, a plurality of elastic members 12 and a joining member 13.

The number of the elastic members 12 may be three. Each elastic member 12 may be an elastic band.

The fixing member 11 comprises a base 111, a first fixing part 112 and a second fixing part 113. The base 111 of the fixing member 11 is a hollow column. The first fixing part 112 and the second fixing part 113 extend from two sides of the base 111. Each of the first fixing part 112 and the second fixing part 113 has a plurality of mounting parts 1121, 1131, the number of which is corresponding to that of the elastic members 12. Since the number of the elastic members 12 in this embodiment is three, the number of the mounting parts 1121 is three, too. Each of the mounting parts has an annular structure. The middle one of the mounting parts has a structure with a shape of a complete ring and each of the other two has a structure with a shape of a semi ring.

The joining member 13 has a plurality of joining parts 131 corresponding to the elastic members 12 in number. Each of the joining parts 131 has an annular structure.

The joining member 13 is arranged above the fixing member 11. As shown, the joining parts 131 and the mounting parts 1121, 1131 all have annular structures, some of which may be shaped as a complete ring or some of which may be shaped as a semi ring. The number of the rings is three, i.e. equal to the number of the elastic members 12. Each of the elastic members 12 passes through the mounting parts 1121 of the first fixing part 112 of the fixing member 11, the jointing parts 131 of the jointing member 13, and then the mounting parts 1131 of the second fixing member 113 of the fixing member 11. That is to say, the elastic members 12 sequentially pass through the corresponding mounting part 1121 of the first fixing part 112 of the fixing member 11, the corresponding jointing part 131 of the jointing member 13 and the corresponding mounting part 1131 of the second fixing member 113 of the fixing member 11, respectively. Thus, as shown in the drawings, each of the elastic bands is formed in a "W" shape.

In use, when the distance between the fixing member 11 and the joining member 13 is increased, the elastic members are also stretched with the same elastic force.

The Second Embodiment

Referring to FIGS. 1 to 5, an exercise chair 2 used for exercise comprises: a backrest 21; a seat 22; a support 23 under the seat 22; and a sliding device 24 connected under the support 23.

An air pump 26 for adjusting the height of the seat 22 is provided on the support 23 of the chair 2. For adjusting the height of the seat 22, an adjusting valve is provided in the air pump 26, so that the height of the seat can adapt to the height of the user. A receiving part 25 is fixed under the seat 22 of the chair 2 and is formed by bending an iron sheet. The sliding device 24 is connected under the support 23 to facilitate moving the chair 2.

The chair 2 is provided with an exercise assembly 1 which comprises a fixing member 11, a plurality of elastic members 12 and a joining member 13.

The number of the elastic members 12 may be three. Each of the elastic members 12 is an elastic band. A handle 14, which is convenient to be grasped by a user, is provided at two ends of each of the elastic members 12. Two ends of one of the three elastic members 12 is mounted at two sides of the top of the backrest, so that the elastic member can be hidden in the tubular structure employed in the chair. The two ends of each of the other two elastic members are mounted under the seat. Thus, the two elastic members are hidden in the receiving part 25. Consequently, the chair has a better appearance.

The fixing member 11 comprises a base 111, a first fixing part 112 and a second fixing part 113. The base 111 of the fixing member 11 is a hollow column. The first fixing part 112 and the second fixing part 113 extend from two sides of the base 111. Each of the first fixing part 112 and a second fixing part 113 has a plurality of mounting parts 1121, 1131. The number of mounting parts is corresponding to that of the elastic members 12. Since the number of the elastic members 12 in this embodiment is three, the number of the mounting parts is three, too. Each of the mounting parts has an annular structure. As shown in the drawings, the middle one of the mounting parts has a structure with a shape of a complete ring and each of the other two has a structure with a shape of a semi ring. The fixing member 11 is fixed to the support 23. In this embodiment, a fixing block 27 is welded to the support 23 so as to secure that the fixing member 11 is fixedly connect to the support 23.

A joining member 13 is provided with a plurality of joining parts 131 corresponding to the elastic members 12 in number. Each of the joining parts 131 has an annular structure. The joining members 13 are fixed under the seat 22.

The fixing member 11 is fixed to the support 23 and the joining members 13 are provided under the seat 22. Therefore, the joining members 13 are arranged above the fixing member 11. As shown, the joining parts 131 and the mounting parts 1121, 1131 all have annular structures, some of which may be shaped as complete rings or some of which may be shaped as semi rings. In the embodiment, the number of the rings is three, i.e. equal to the number of the elastic members 12. Each of the elastic members 12 passes through one mounting part 1121 of the first fixing part 112 of the fixing member 11, one jointing part 131 of the jointing member 13, and then one mounting part 1131 of the second fixing member 113 of the fixing member 11. That is to say, the elastic members 12 sequentially pass through the corresponding mounting part 1121 of the first fixing part 112 of the fixing member 11, the corresponding jointing part 131 of the jointing member 13 and the corresponding mounting part 1131 of the second fixing member 113 of the fixing member 11, respectively. Thus, as shown in the drawings, each of the elastic bands is formed in a "W" shape.

In use, the user can take exercise upon holding the handles 14 provided on the ends of the elastic members. If the extensile force of the elastic bands is too small, the user can adjust the air pump 26 to increase the distance between the fixing member 11 and the joining member 13, so as to stretch each of the elastic members at the same time. Therefore, the elastic force of all the elastic bands is increased and the extensile force acting on every handle 14 is the same to one another. That is to say, the user can adjust the extensile force of the elastic bands according to his/her practice and body conditions to take exercise.

While particular embodiments of the present invention have been illustrated and described, it would be obvious to those skilled in the art that various other changes and modifications can be made without departing from the spirit and scope of the invention. Therefore all such changes and modifications fall within the metes and bounds of the claims are intended to be embraced by the appended claims.

What is claimed is:

1. a chair and exercise assembly attachment, comprising:

a chair including a support, a seat displaceably mounted to the support, and a backrest secured to the seat; and an exercise assembly attached to the chair, the exercise assembly including:

a plurality of elastic members;

a fixing member affixed on the support, the fixing member including (a) a base, (b) a first fixing part and (c) a second fixing part, each the fixing part extending from a side of the base, each the fixing part having a plurality of mounting parts, wherein the number of mounting parts is in correspondence with the number of elastic members and at least a portion of the mounting parts have a U-shaped contour; and joining member affixed under the seat and above the fixing member, and having a plurality of joining parts, the number of joining parts corresponding to the number of elastic members and each of the joining parts having a U-shaped contour;

wherein the elastic members respectively sequentially pass through the corresponding mounting part of the first fixing part, the corresponding joining part of the joining member and the corresponding mounting part of the second fixing part, a tension of the elastic members being adjusted by a height adjustment mechanism of the chair to displace the seat relative to the support.

2. The chair according to claim 1, wherein the base of the fixing members is a hollow column.

3. The chair according to claim 1, wherein the mounting part has an annular structure.

4. The chair according to claim 1, wherein an air pump is provided on the support for adjusting the height of the seat relative to the support.

5. The chair according to claim 1, wherein the number of the elastic members is three.

6. The chair according to claim 5, wherein two ends of one of three elastic members are mounted on two sides of a top of the backrest, and the ends of the other two elastic members are mounted under the seat.

7. The chair according to claim 5, wherein the elastic member is an elastic band.

8. The chair according to claim 7, wherein a handle which is convenient to be grasped by a user is provided at each end of the elastic member.

9. The chair according to claim 8, wherein a receiving part for receiving the handle is provided under the seat.

10. An exercise assembly for attachment to a chair, comprising:

a plurality of elastic members;

a fixing member comprising: a base, and a first fixing part and a second fixing part each fixing part extending from a side of the base, each fixing part having a plurality of mounting parts, the number of mounting parts corresponding to the number of elastic members and at least a portion of the mounting parts having a U-shaped contour; and a joining member having a plurality of joining parts, the number of joining parts corresponding to the number of elastic members and each of the joining parts having a U-shaped contour;

wherein the elastic members respectively sequentially pass through the corresponding mounting part of the first fixing part, the corresponding joining part of the joining member and the corresponding mounting part of the second fixing part.

11. The exercise assembly according to claim 10, wherein the number of the elastic members is three.

12. The exercise assembly according to claim 11, wherein the elastic member is an elastic band.

13. The exercise assembly according to claim 10, wherein the base of the fixing member is a hollow column.

14. The exercise assembly according to claim 10, wherein the mounting part has an annular structure.

15. The exercise assembly according to claim 10, wherein the joining part has an annular structure.

* * * * *